US007938696B2

(12) United States Patent
Genau et al.

(10) Patent No.: US 7,938,696 B2
(45) Date of Patent: May 10, 2011

(54) SYMMETRICAL ELECTRIC CONTACT

(75) Inventors: Melanie Genau, Luebbecke (DE); Gert Havermann, Wallenhorst (DE); Hubert Breitfeld, Rahden (DE); Stefan Baumert, Pollhagen (DE)

(73) Assignee: Harting Electronics GmbH & Co. KG (DE)

( * ) Notice: Subject to any disclaimer, the term of this patent is extended or adjusted under 35 U.S.C. 154(b) by 101 days.

(21) Appl. No.: 12/560,277

(22) Filed: Sep. 15, 2009

(65) Prior Publication Data

US 2010/0075543 A1 Mar. 25, 2010

(30) Foreign Application Priority Data

Sep. 24, 2008 (DE) ..... 10 2008 048 731

(51) Int. Cl.
*H01R 11/22* (2006.01)

(52) U.S. Cl. ..... 439/857; 439/290

(58) Field of Classification Search ..... 439/852, 439/856, 857, 862, 290, 291
See application file for complete search history.

(56) References Cited

U.S. PATENT DOCUMENTS

| | | | | |
|---|---|---|---|---|
| 2,554,876 | A | 5/1951 | Olson | |
| 3,440,596 | A | 4/1969 | Frompovicz | |
| 3,669,054 | A * | 6/1972 | Desso et al. | 29/874 |
| 4,082,397 | A | 4/1978 | Tanaka et al. | 339/49 |
| 4,230,383 | A * | 10/1980 | Burnstein et al. | 439/620.25 |
| 4,747,794 | A * | 5/1988 | Seidler | 439/857 |
| 4,778,231 | A * | 10/1988 | Seidler et al. | 439/857 |
| 4,917,614 | A | 4/1990 | Kikuchi et al. | 439/83 |
| 5,013,263 | A | 5/1991 | Gordon et al. | 439/630 |
| 5,052,940 | A | 10/1991 | Bengal | 439/188 |
| 5,445,529 | A | 8/1995 | Yamamoto | 439/81 |
| 5,599,213 | A * | 2/1997 | Frommer et al. | 439/857 |
| 6,254,440 | B1 | 7/2001 | Ko et al. | 439/857 |

(Continued)

FOREIGN PATENT DOCUMENTS

DE 1 640 022 5/1970

(Continued)

OTHER PUBLICATIONS

European Official Action dated Jul. 7, 2010.

(Continued)

*Primary Examiner* — Neil Abrams
*Assistant Examiner* — Phuong T Nguyen
(74) *Attorney, Agent, or Firm* — Hayes Soloway P.C.

(57) ABSTRACT

For the transmission of high-frequency signals >2.5 GHz or 5 Gbps by means of a separable plug connection, the invention proposes a symmetrically shaped electric contact (1, 1') that features a contact body (4) with the contact side (3) with U-shaped spring legs (13), as well as a connection end (5). Contact domes (15) that are directed toward one another and feature contact zones (16) that are narrower than the material thickness of the spring legs (13) are integrally formed onto both spring legs (13).

When joining the two electric contacts (1, 1') that are mated while they are turned relative to one another by 90 degrees in the mating direction, the contact domes (15) or their contact zones (16) of one electric contact (1, 1') engage into the contact body (4) of the other electric contact (1, 1') in a paired fashion such that electric signals travel distances with identical transit times on one leg and on the other leg and so-called stub effects, i.e., transit time differences that cause a partial obliteration of certain signal portions, due to different distances in a contact wiring are prevented.

12 Claims, 9 Drawing Sheets

U.S. PATENT DOCUMENTS

| | | | | |
|---|---|---|---|---|
| 6,302,711 | B1 | 10/2001 | Ito | 439/83 |
| 7,387,521 | B1 | 6/2008 | Weber | 439/224 |
| 2008/0188112 | A1 | 8/2008 | Ju et al. | 439/342 |

FOREIGN PATENT DOCUMENTS

| | | |
|---|---|---|
| DE | 27 39 072 | 8/1978 |
| EP | 0 456 396 | 11/1991 |
| EP | 0 641 043 | 3/1995 |
| FR | 2 600 831 | 6/1986 |
| FR | 2 600 825 | 12/1987 |

OTHER PUBLICATIONS

German Search Report, dated Apr. 7, 2009.

* cited by examiner

SYMMETRICAL ELECTRIC CONTACT

BACKGROUND OF THE INVENTION

1. Field of the Invention

The invention pertains to a symmetrical electric contact for mutually contacting, consisting of a contact body with a contact side and a connection side that is inserted into a plug body for separably contacting plug connectors in order to transmit high-frequency signals.

2. Description of the Related Art

A symmetrical contact of this type is required for a separable plug connection, in which high-frequency signal need to be transmitted in a largely interference-free fashion.

In the signal transmission of high-frequency signals, a signal division occurs at the contact point in a simple, classic spring-knife design, wherein one signal part is transferred directly at the contact point between the knife and the spring and the other part continues to move into the point of the knife and is reflected at this location. Back at the contact point, the process is repeated and the reflected signal part is superimposed on the original signal. The difference of phase between the two signals therefore depends on the mating depth that is predetermined by the mechanism of the Plug system. The original signal may be so adulterated depending on the difference of phase that signal portions or the entire original signal are obliterated. This is also known as a stub effect.

SUMMARY OF THE INVENTION

The invention therefore is based on the objective of designing a symmetrical electric plug connector contact for the transmission of high-frequency signals in such a way that look reflections and transit time differences of the signals are reduced to a minimum regardless of the mating depth.

This objective is attained in that the contact side features symmetric spring legs that are shaped out of the contact body, in that inwardly directed contact domes with contact zones that are provided opposite of one another on the free ends of the spring legs, and in that the contact domes are, referred to the material thickness of the contact body in the contact direction, realized narrower than the spring of legs toward the contact zone.

The advantages attained with the invention can be seen, in particular, in that such a plug connector needs to be equipped with one type of the electric contacts only.

In this case, the electric contacts are formed by a contact body with a contact side and the connection side, wherein the context side is provided with two integral, symmetrical spring legs with opposing contact domes that feature a rounded contact sounds. Similar to a segment of a circle, the contact domes are realized in the form of a shoulder and have a material thickness that is thinner than the general material thickness of the spring legs and the contact body.

The connection end of the contact body on the opposite end of the spring legs is provided with a terminal pin that is angled relative to the spring legs by 90 degrees, i.e., transverse to the mating direction, and features a soldering surface for a surface soldering. In addition, the terminal and is angled relative to the surface of the contact body by 45 degrees.

When mating two symmetrical contacts of identical design, they are offset relative to one another by 90 degrees in the mating direction such that the two spring legs respectively contact the contact body of the other contact.

Since the contact domes form the ends of the electric contacts and touch the other contact with these contact domes, the transit times of a divided electric signal that is transmitted to the contact domes via these spring legs are identical such that a superposition of both signal portions once again results in the original signal.

It is furthermore advantageous to provide a plug body, into which the symmetrical electric contacts can be inserted. The plug body features intersecting, rectangularly shaped chambers for accommodating the electric contacts. One of the chambers is provided for respectively engaging with an electric contact while the second chamber only has a certain mating depth, into which the electric contact of a mating connector equipped with the same contacts can be inserted.

In one variation of the plug body, the spring legs of the electric contacts that are directed toward the mating side are advantageously guided on at least one side in partial chambers formed in at least one longitudinal wall extending through the plug body. In this case, the spring legs are guided in the partial chambers until they almost reach the contact domes.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1:
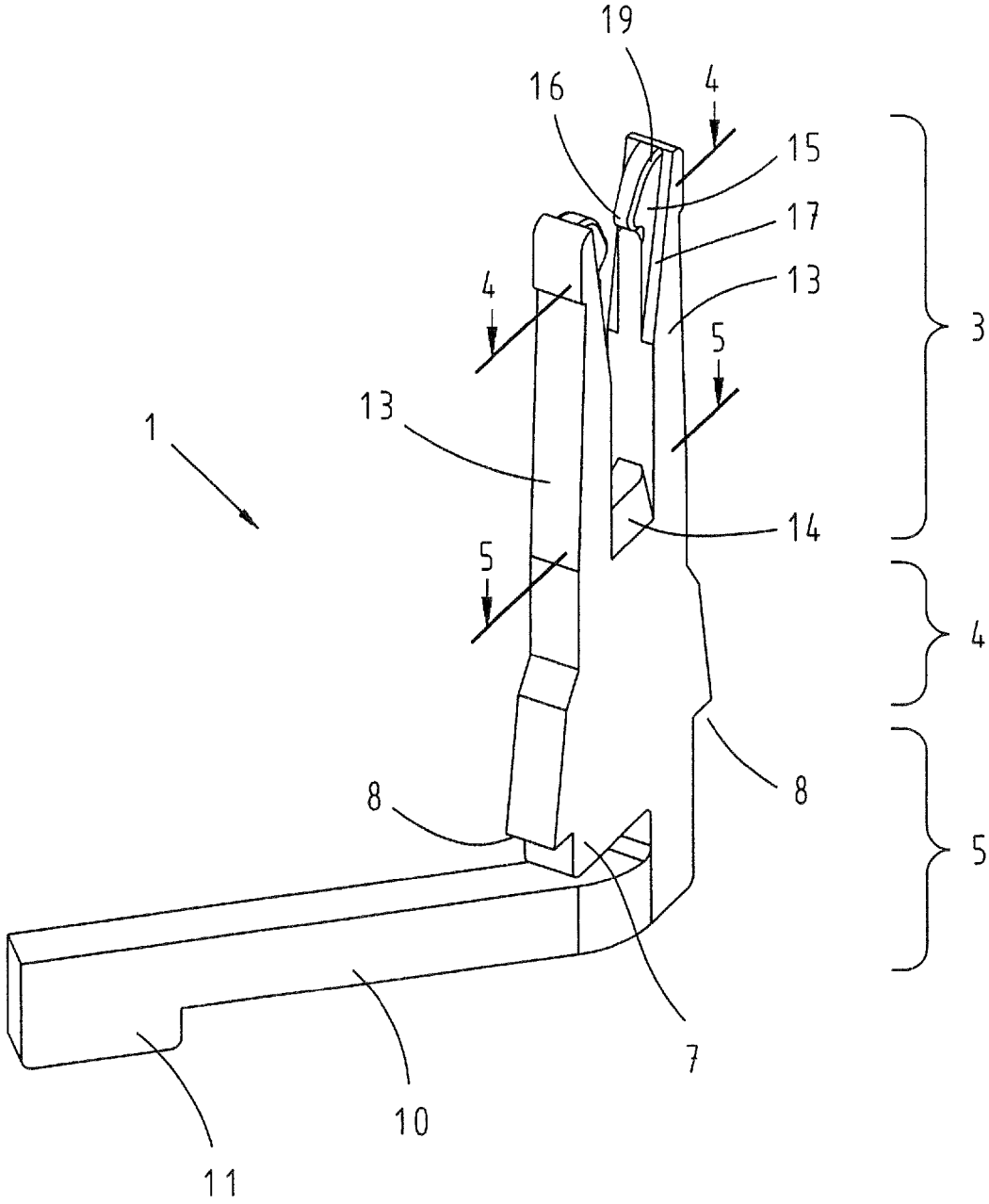
FIG. 1 shows an individual symmetrical electric contact with a stepped contact dome.

FIG. 1 shows an individual symmetrical electric contact 1 that consists of a punched metallic contact body 4 with a contact side 3 and a connection end 5.

The contact body 4 has a slightly trapezoidal shape, on the tapered side of which the contact side 3 with its U-shaped spring legs 13 is arranged, wherein opposing contact zones 16 of symmetrical shape are arranged on the contact domes 15 on the ends of said spring legs.

In this case, the contact domes 15 are shaped parallel to the contact zones 16 and realized narrower than the remaining materials thickness of the spring legs 13 with the aid of a shoulder 17. The shoulder 17 may have different lengths.

At the starting points of the two spring legs 13 on the contact body 4, a beveled transition zone 14 to the spring legs 13 of the contact body 4 is provided.

The connection side 5 that is arranged on the opposite end of the contact side 3 consists of an integral terminal pin 10 that is angled relative to the contact body 4 in the punching direction of the contact 1 by approximately 45 degrees.

The terminal pin 10 is held on a connection part 7 that is integrally formed onto the wider side of the trapezoid, wherein the connection part 7 is, however, realized narrower than this side of the trapezoid. This means that a so-called undercut 8 is formed to both sides of the connection part 7 such that the contact 1 can be snapped into a plug body 20.

The terminal pin 10 is integrally formed onto one of the vertical sides of the connection part 7 and horizontally arranged underneath the connection part 7, wherein said terminal pin features a slightly offset soldering surface 11.

Figure 2:
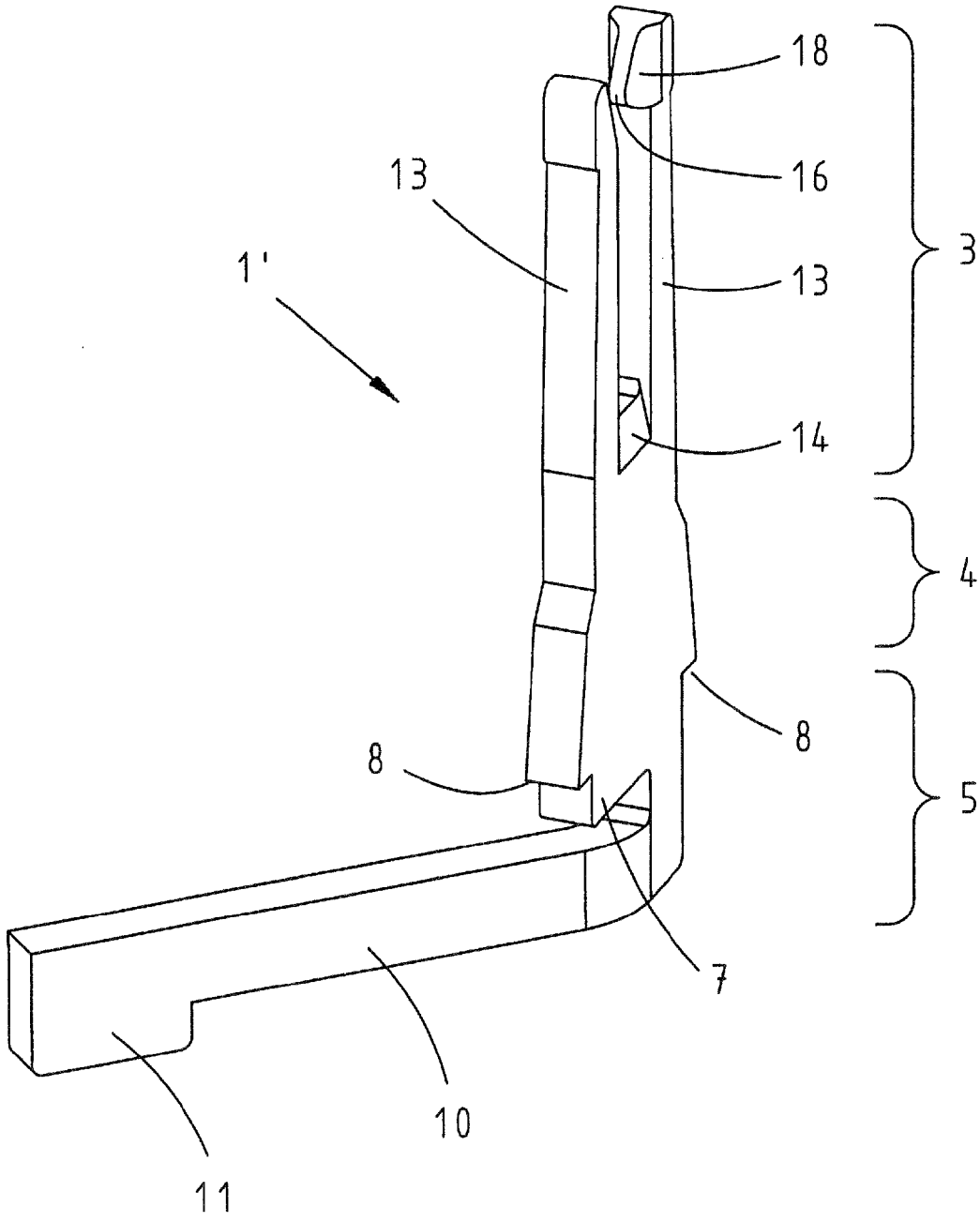
FIG. 2 shows an individual symmetrical electric contact with an oblique contact dome.

According to FIG. 2, an embodiment is proposed, in which the contact domes have the shape of a bevel 18 in one variation of an electric contact 1', i.e., such that it becomes narrower from the material thickness of the spring legs 13 to the contact zone 1.

Figure 3:
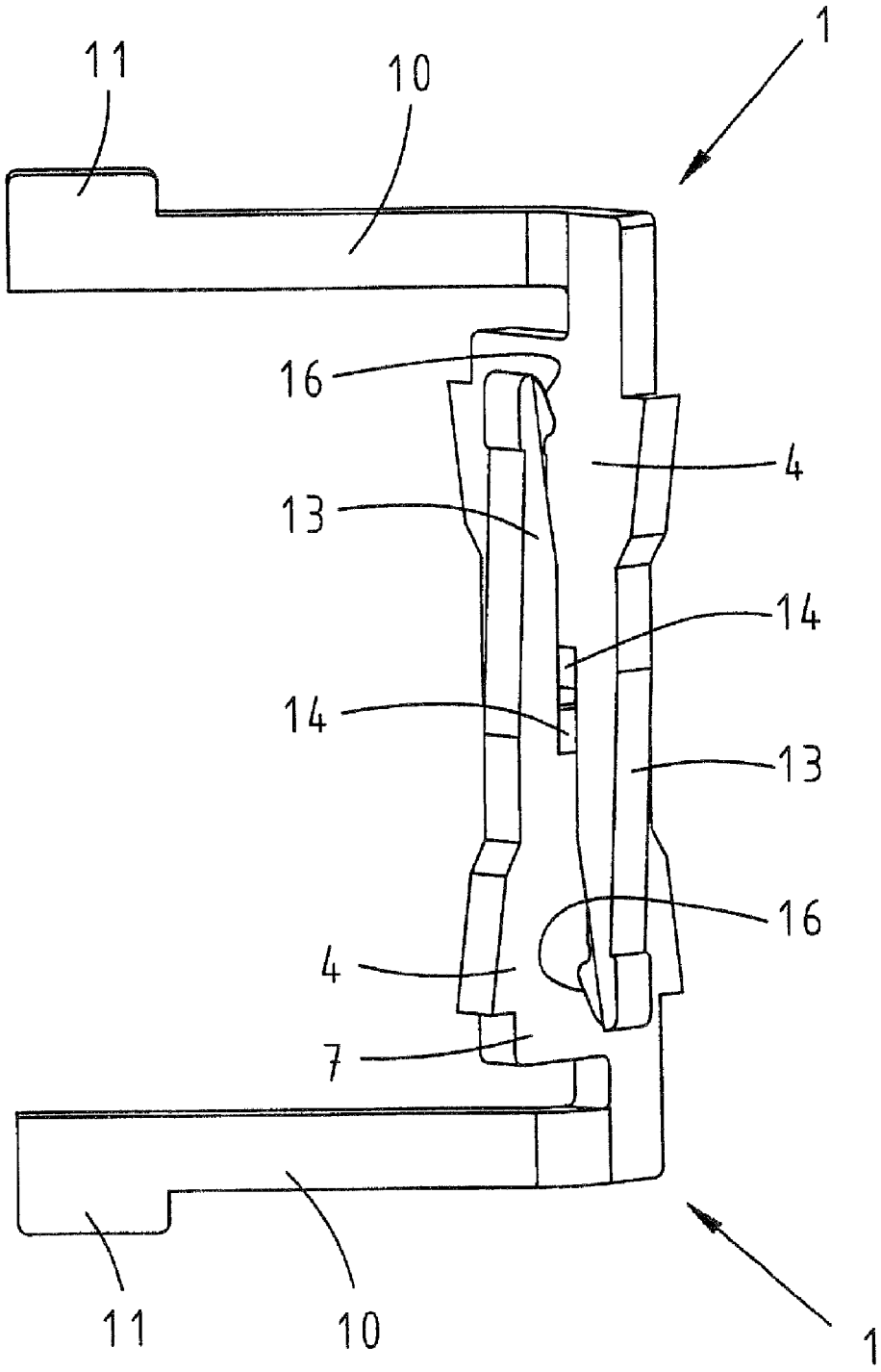
FIG. 3 shows an aspect of two symmetrical contacts that are mated crosswise.

FIG. 3 shows two mated electric contacts 1. The two symmetrical contacts are turned relative to one another by 90 degrees in the mating direction.

This figure initially shows the function of the oblique transition zone 14 between the spring legs 13 for widening the contact domes 15 to the material thickness of the contact body 4.

The contact domes 15 are respectively pushed on the other contact 1 with their contact zones 16, namely almost up to the point, at which the electric contacts mutually contact on the transition zone 14.

Figure 4:
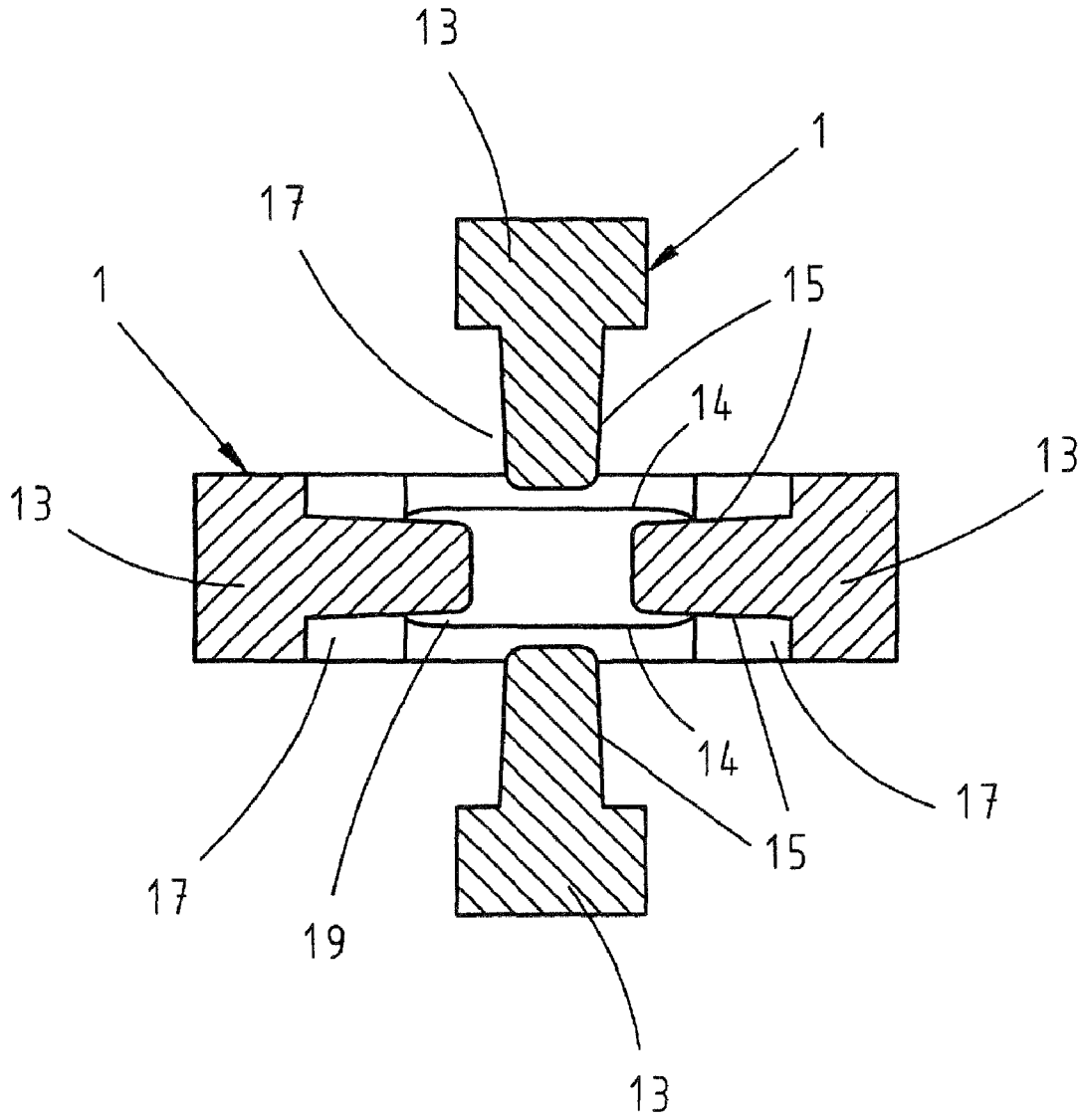
FIG. 4 shows a vertical section through not yet contacted in electric contacts that are mated crosswise.

In this context, FIG. 4 shows how two electric contacts 1, 1' are mated before the contact zones 16 contact the other contact body. This is indicated in FIG. 1 with the line 4-4, at the height of which the two contact zones 16 of the electric contacts are approximately situated.

With respect to the geometry of the contact domes 15, the electric contacts shown are designed in such a way that they do not touch during the mating process.

For this purpose, the contact domes 15 are designed narrower than the spring legs 13 such that no mutual contact occurs during the mating process and the contact domes 15 are not bent apart in order to mutually contact the contact body 4 until the contact zones 16 are pushed onto the bevel 14 between the spring legs 13.

Figure 5:
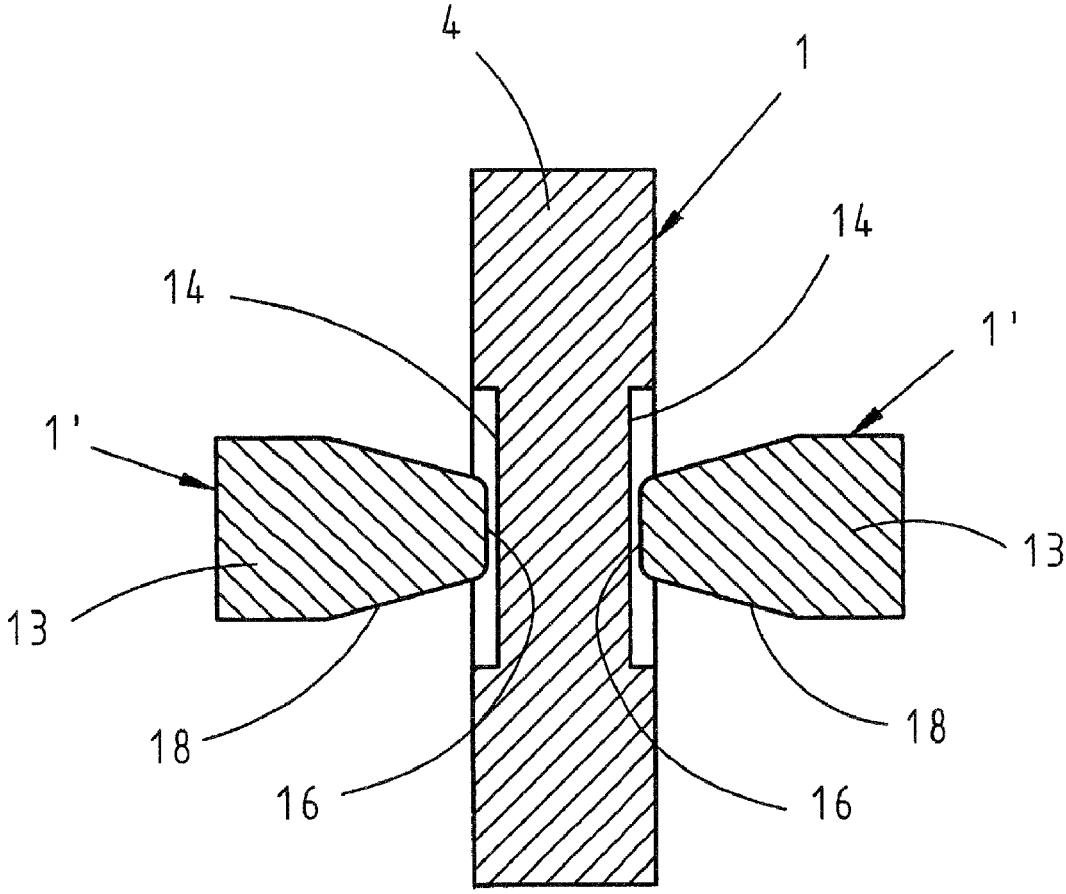
FIG. 5 shows a vertical section of linearly contacting contacts that are mated crosswise.

FIG. 5 shows the time, at which two electric contacts 1' are mated, wherein these electric contacts do not feature a shoulder 17, but rather a bevel 18 on the contact domes 15 between the spring legs 13 and the contact zones 16, namely the time when the two contact zones 16 reach the transition zone 1 and before the contact domes 15 are widened and contact the contact body 4.

Figure 6:
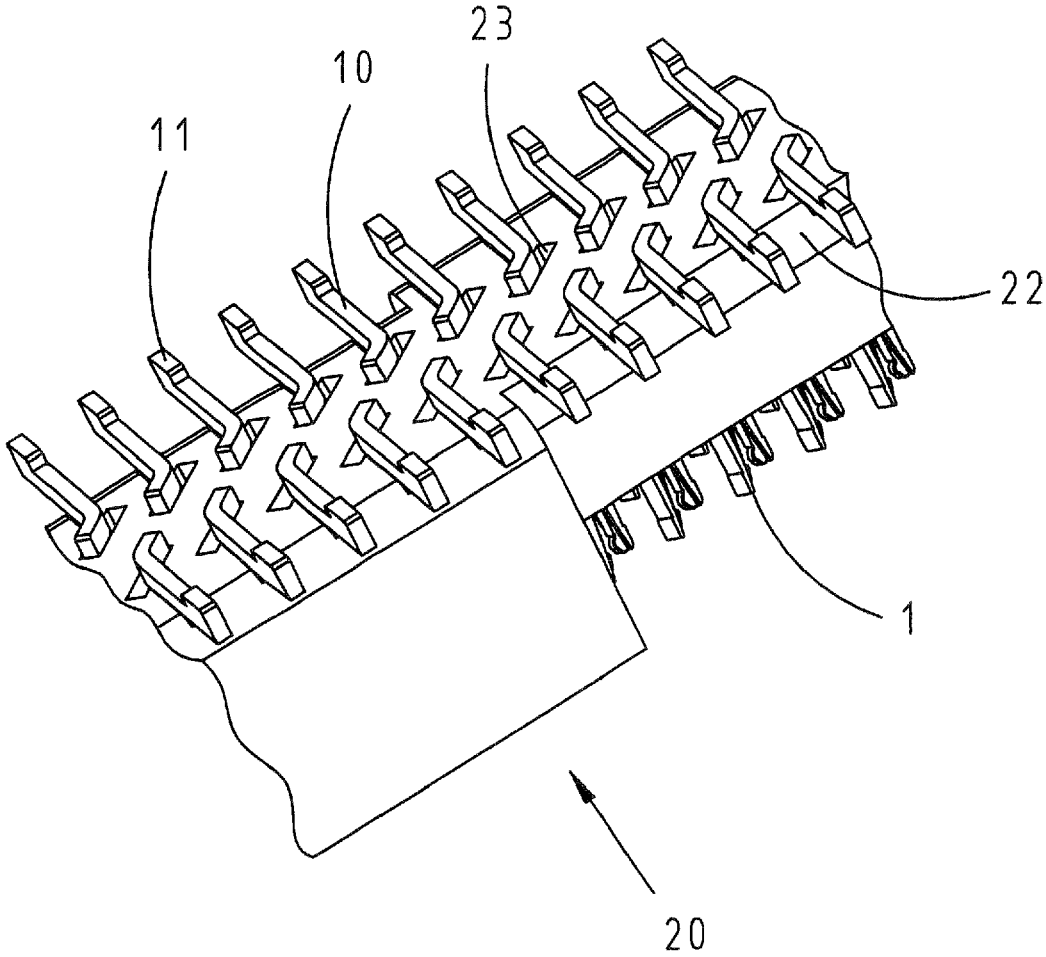
FIG. 6 shows a detail of a plug body for the symmetrical contacts, namely viewed in the direction of the soldering side.

This is indicated in FIG. 1 with the line 5-5, at the approximate height of which the two contact zones 16 of the electric contacts are situated. FIG. 6 shows a detail of the plug body 20, into which a number of individual symmetrical electric contacts 1 are inserted in two rows.

To this end, rectangular chambers 23 are provided on the soldering side 22 and offset relative to the longitudinal direction of the plug body 20 by 45 degrees, wherein these rectangular chambers are guided as far as the mating side 21 of the plug body, and wherein the electric contacts 1 are inserted and engaged in said chambers.

In this case, an undercut 8 of the contact body 4 snaps into a corresponding recess within the chamber 23. Since the chambers 23 are offset by 45 degrees and their terminal pins 10 are bent by 45 degrees, the inserted contacts now extend out of the plug body laterally to the longitudinal direction at an angle of 90 degrees.

Figure 7:
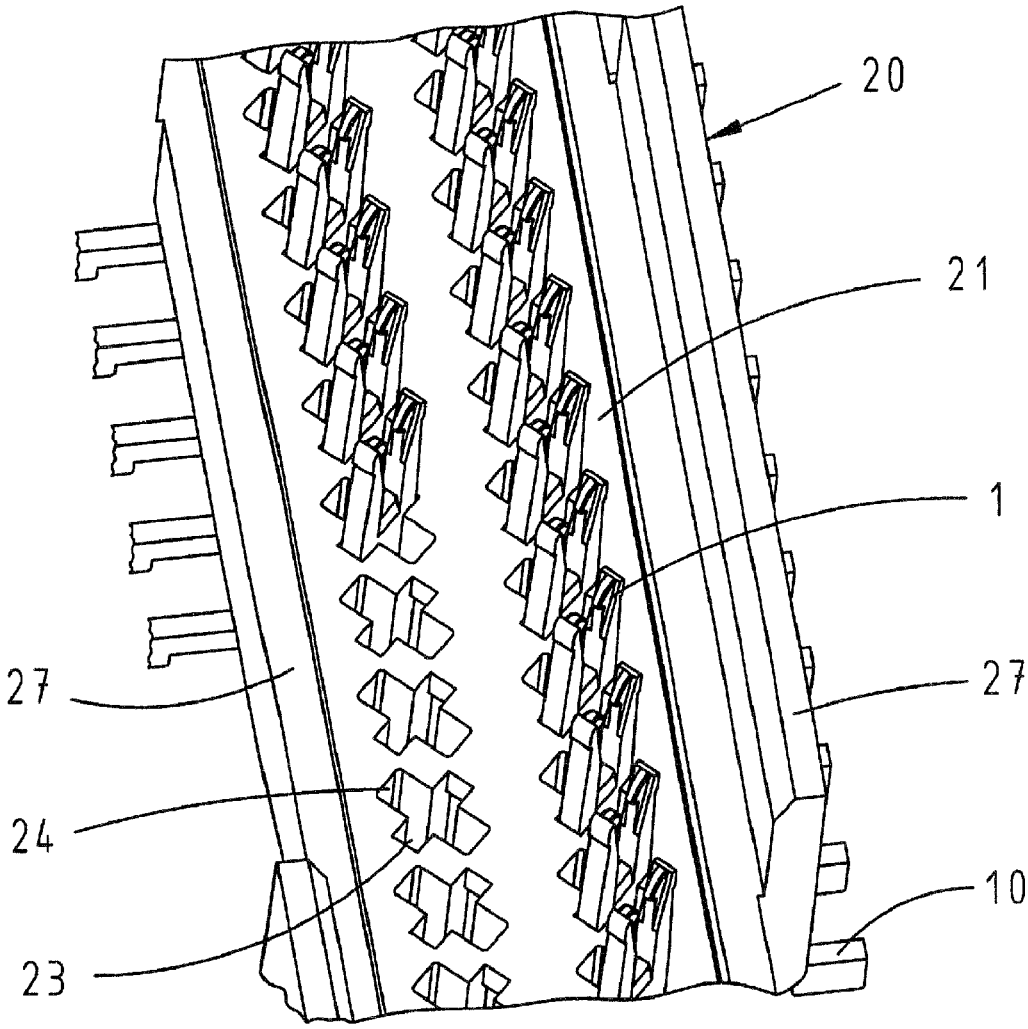
FIG. 7 shows a detail of the plug body with electric contacts inserted therein, namely viewed in the direction of the mating side.

FIG. 7 shows a detail of the mating side 21 of the plug body 20.

The mating side 21 features a series of electric contacts that are aligned at an angle of 45 degrees referred to the longitudinal direction of the plug body 20 in the chambers.

In addition, chambers 24 are provided that intersect the chambers 23, wherein the electric contacts 1 of a mating connector can be inserted into these chambers in order to mutually contact in an intersecting fashion.

However, the rectangular chambers 24 are merely realized in accordance with the maximum depth of insertion of the mating side of the mating connector contacts 1 within the plug body 20.

Figure 8:
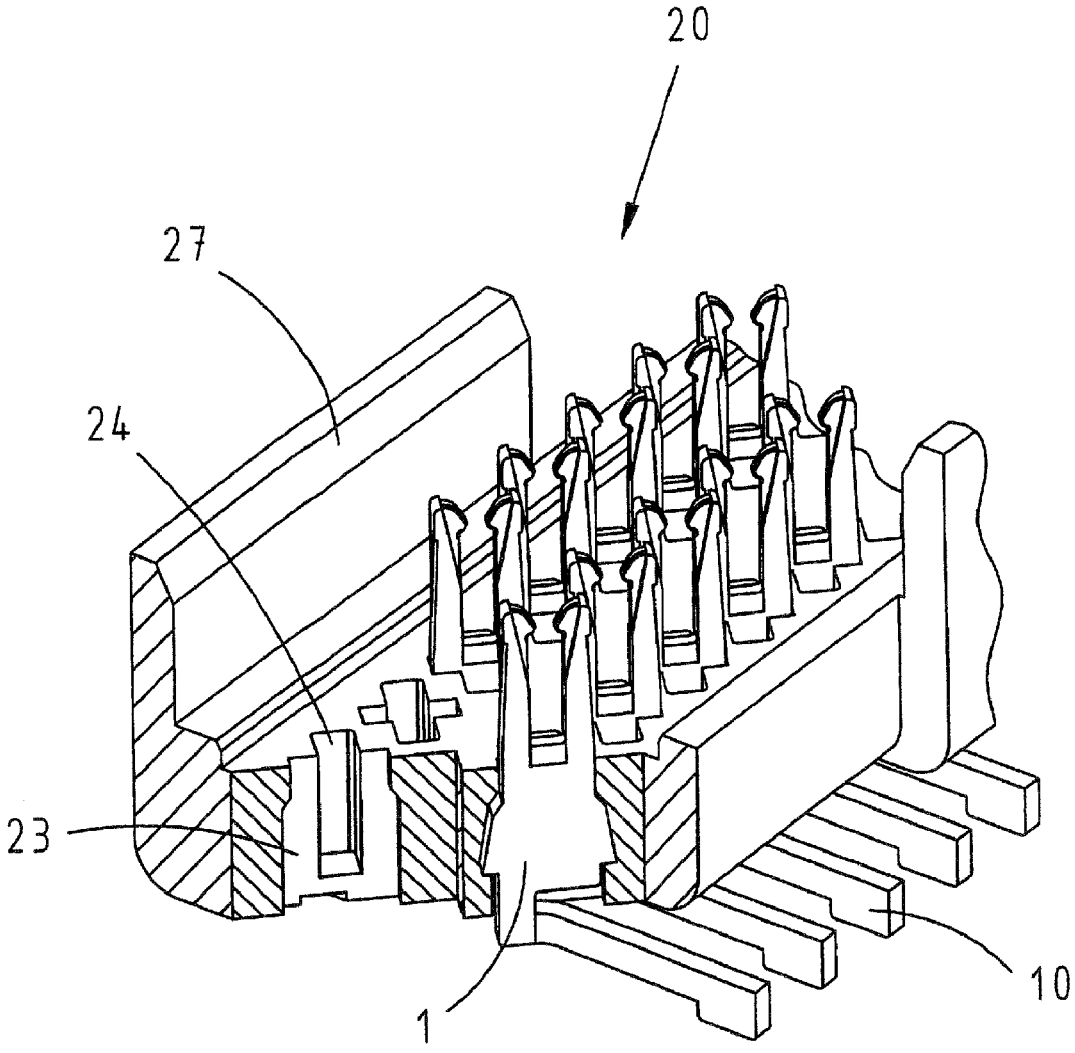
FIG. 8 shows a section through the plug body with an electric contact.

FIG. 8 shows a section through a plug body 20 with electric contacts 1 arranged therein.

In this case, the electric contacts 1 are inserted into the chamber 23 extending through the plug body 20 from the soldering side 22 and engaged by means of the undercuts 8.

The chamber 24 that is respectively provided for the mating connector or its electric contacts 1 and intersects the chamber 23 only has a limited depth of insertion such that the contact domes 16 of one electric contact 1 always contact the contact body 4 of the other electric contact 1 and approximately optimal electric transmission properties are achieved in the plug connection, namely also for high-frequency signals.

Figure 9:
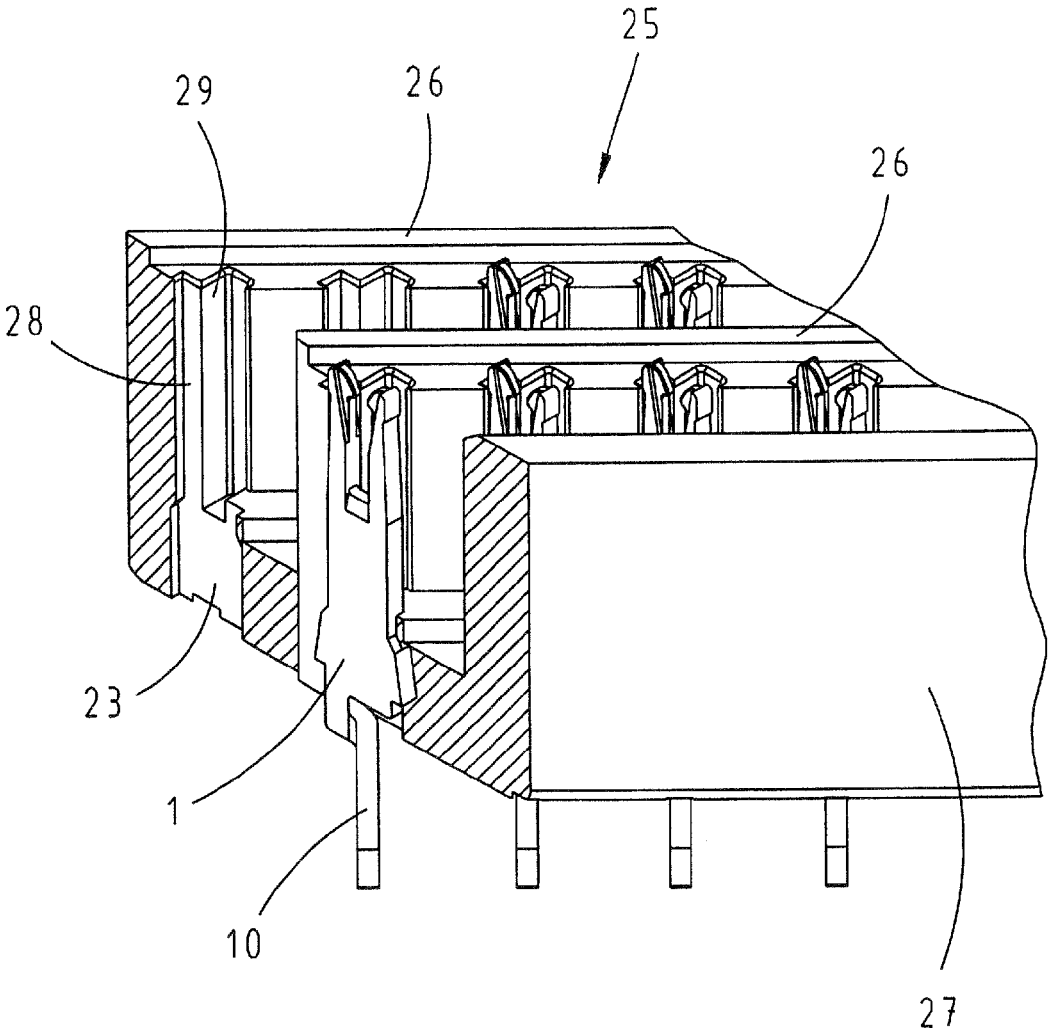
FIG. 9 shows the section through a variation of a plug body with partially extended partial chambers and electric contacts protected therein.

FIG. 9 shows a variation of the plug body 25. In order to achieve a superior mechanical protection of the spring legs 13 of the electric contacts 1 during the mating process, a longitudinal half of the spring legs 13 is respectively surrounded by an extended longitudinal wall 26 in partial chambers 28 of the plug body 25. In this case, the partial chamber 28 is a one-sided extension of the rectangular chamber 23 of the already shown plug body 20. In a mated connector, the other half of the spring legs 13 lies in a corresponding partial chamber 29. In this case, the partial chamber 28 is realized narrower in the plug body 25 than the partial chamber 29, into which the electric mating contact still needs to be inserted in a crosswise fashion, in order to better guide the already inserted spring leg 13.

In a two-line contact row, the plug body 25 features at least three continuous longitudinal walls 26, 26, 27, wherein the respective partial chambers, 28, 29 are formed in the longitudinal walls 26 at an angle of 90 degrees.

What is claimed is:

1. A symmetrical electric contact for the transmission of high-frequency signals, comprising a contact body with a contact side and a connection side that is inserted into a plug body for separably contacting plug connectors, wherein the contact side has symmetric spring legs that are formed out of the contact body, in that inwardly directed contact domes with contact zones are provided opposite one another on the free ends of the spring legs, in that the contact domes have a body thickness in the contact direction, that is thinner than the spring legs;

the contact domes are narrower than the spring legs with a step of a shoulder, wherein the shoulder with the contact domes has the approximate shape of a segment of a circle.

2. The symmetrical electric contact according to claim 1, wherein the contact domes are arranged opposite one another in a narrowing fashion toward the contact zone by a symmetrical bevel.

3. The symmetrical electric contact according to claim 1, wherein the contact domes feature roundings.

4. The symmetrical electric contact according to claim 1, wherein the contact domes with their contact zones are spaced apart from and arranged opposite of one another, as well as aligned parallel to one another.

5. The symmetrical electric contact according to claim 1, wherein a signal transmission of two mated electric contacts is respectively realized on the ends of the spring legs of the contact body at the step of the content zones, wherein the contacting of the contact zones of one contact is always realized while the contact is turned by 90 degrees in the mating direction on the contact body of the other contact.

6. The symmetrical electric contact according to claim 1, wherein the connection end is realized in the form of a terminal pin and exposed on three sides, wherein the terminal pin is integrally formed on the contact body transverse to the mating direction and bent relative to the surface of the contact body by 45 degrees.

7. The symmetrical electric contact according to claim 1, wherein a double-sided oblique transition zone is provided on the contact body in the region between the spring legs.

8. A plug body having a mating side and a soldering side for use with a symmetrical electric contact as claimed in claim 1, wherein the electric contacts are arranged in the plug body in at least one row and respectively turned relative to the longitudinal side of the plug body by 45 degrees, wherein the connection ends of the electric contacts in the form of terminal pins extend out of the plug body at an angle of 90 degrees relative its longitudinal side.

9. The plug body according to claim 8, wherein the chamber for inserting the contacts into the plug body is aligned at an angle of 45 degrees referred to the longitudinal direction of the plug body on the soldering side.

10. The plug body according to claim 8, wherein chambers for accommodating the electric contacts are provided in a crosswise fashion on the mating side, wherein the chamber respectively accommodates the contact side of the contact while the other chamber that is offset by 90 degrees serves for accommodating the contact side of the contact of a mating connector.

11. The plug body according to claim 10, wherein the chamber extends as far as the mating side of the plug body while the crosswise chamber only regionally extends from the mating side into the plug body.

12. The plug body according to claim 10, wherein a plug body is formed with extended longitudinal walls, in which partial chambers are arranged in order to at least regionally enclose the spring legs of the electric contacts therein.

* * * * *